US006042072A

United States Patent [19]

Chi-Nan

[11] Patent Number: 6,042,072

[45] Date of Patent: Mar. 28, 2000

[54] STRUCTURE CEILING FAN MOUNT

[76] Inventor: Wang Chi-Nan, P.O. Box 63-150, Taichung City, Taiwan

[21] Appl. No.: 09/330,565

[22] Filed: Jun. 11, 1999

[51] Int. Cl.[7] ..... B42F 13/00; A47B 96/06; B25G 3/00

[52] U.S. Cl. ..... 248/343; 248/222.52; 403/348; 403/350

[58] Field of Search ..... 248/343, 222.52; 403/348, 350

[56] References Cited

U.S. PATENT DOCUMENTS

| | | | |
|---|---|---|---|
| 1,471,494 | 10/1923 | Lubow . | |
| 4,286,159 | 8/1981 | Kitta et al. | 403/348 |
| 4,754,383 | 6/1988 | Klaus | 248/343 |
| 5,407,295 | 4/1995 | Kuhl | 403/350 |
| 5,900,583 | 12/1997 | Russo | 248/343 |
| 5,941,625 | 8/1999 | Morand | 248/343 |
| 5,947,436 | 8/1998 | Bucher et al. | 248/343 |

*Primary Examiner*—Anita M. King
*Assistant Examiner*—Jerome DeLuca

[57] ABSTRACT

An improved structure ceiling fan mount comprised of a suspender frame having a flat mounting plate that is installed onto the ceiling and a carrier fixture with a receptacle extending downward from the center, a suspender rod providing for the suspension and mounting of a ceiling fan and having a hemispherical head section at the top end that is retained in the said carrier fixture, and a mount cover that fits over the circumference of suspender frame. The innovations are that the mounting plate has diametrically aligned and horizontally oriented insertion slots formed in its thick lateral end areas and there is a mounting dimple is formed at the end of each insertion slot. Limit ribs are press formed in alignment with the insertion slots of the mounting plate along the inner diameter of the mount cover and a positioning nib is press formed at the end of each limit rib. Based on this arrangement, the mount cover is rotated onto the circumference of the mounting plate, which causes the limiter ribs and the positioning nibs to become respectively engaged into the insertion slots and the mounting dimples, which permits faster assembly because screws are not required.

2 Claims, 5 Drawing Sheets

STRUCTURE CEILING FAN MOUNT

BACKGROUND OF THE INVENTION

1) Field of the Invention

The invention herein relates to an improved structure ceiling fan mount.

2) Description of the Prior Art

Conventional ceiling fan mounts, as indicated in FIG. 1 and FIG. 2, are comprised of a suspender frame 1, a suspender rod 2, a mount cover 3, and a fastening sleeve 4; of which, the suspender frame 1 has a butterfly-shaped mounting plate 1A, fastened to the ceiling 5 by means the long screws 1B, having a number of threaded mounting holes 1C disposed a certain distance apart along the outer circumference of the said mounting plate 1A, and a mounting carrier 1D under the center of the said mounting plate 1A providing for the retaining of the hemispherical head section 2A situated at the top of a suspender rod 2; the said mount cover 3 is bowl-shaped component that provides for the insertion of the suspender rod 2, fits over the outer circumference of the said suspender frame 1, and has a number of through-holes 3A along its outer circumference that permit the perpendicular entry of the screws 3B into the threaded holes 1C disposed along the outer circumference of the mounting plate 1A to thereby effect the conjoinment of the mount cover 5 to the mounting plate 1A; however, since the exposed arrangement of the screws 3B is unattractive and the screws 3B readily corrode, the plastic injection-molded fastening collar 4 is positioned over the outer circumference of the mount cover 3 after it is installed to hide the originally exposed screws 3B; as such, in addition to fastening the suspender frame 1 to the ceiling 5, as indicated in FIG. 2, the installation of the conventional product also requires the relatively complicated and inconvenient implacement of the mount cover 3 screws 3B into the threaded mounting holes 1C of the mounting plate 1A, especially in cases where the space restrictions of a narrower ceiling 5 do not allow for the perpendicular insertion of the screws 3B, which not only makes installation difficult, but also poses a potential work hazard; furthermore, the fastening collar 4 is a waste of ceiling fan production cost that is not a reasonable economic solution.

In view of foregoing situation, the inventor of the invention herein, based on many years of production and marketing experience in this category of products, conducted intensive research which finally culminated in the practical structure of the invention herein.

SUMMARY OF THE INVENTION

The primary objective of the invention herein is to provide an improved structure ceiling fan mount that can be rapidly assembled and, furthermore, significantly reduces production costs.

Therefore, the improved structure ceiling fan mount of the invention herein is comprised of a suspender frame having a flat mounting plate that is installed onto the ceiling and a carrier fixture with a receptacle extending downward from the center, a suspender rod providing for the suspension and mounting of a ceiling fan and having a hemispherical head section at the top end that is retained in the said carrier fixture, and a mount cover that fits over the circumference of suspender frame; of which, the innovations of the present invention are that the mounting plate has diametrically aligned and horizontally oriented insertion slots of a predetermined length formed in its thick lateral end areas and there is a mounting dimple is formed at the end of each insertion slot; limit ribs are press formed in alignment with the insertion slots of the mounting plate along the inner diameter of the mount cover and a positioning nib is press formed at the end of each limit rib; based on this arrangement, the mount cover is rotated onto the circumference of the mounting plate, which causes the limiter ribs and the positioning nibs to become respectively engaged into the insertion slots and the mounting dimples, which permits faster assembly because screws are not required.

To enable the examination committee to further understand the objectives, innovations, and advantages of the invention herein, the brief description of the drawings below are followed by the detailed description of the preferred embodiments.

DETAILED DESCRIPTION OF THE PREFERRED EMBODIMENTS

Figure 1:
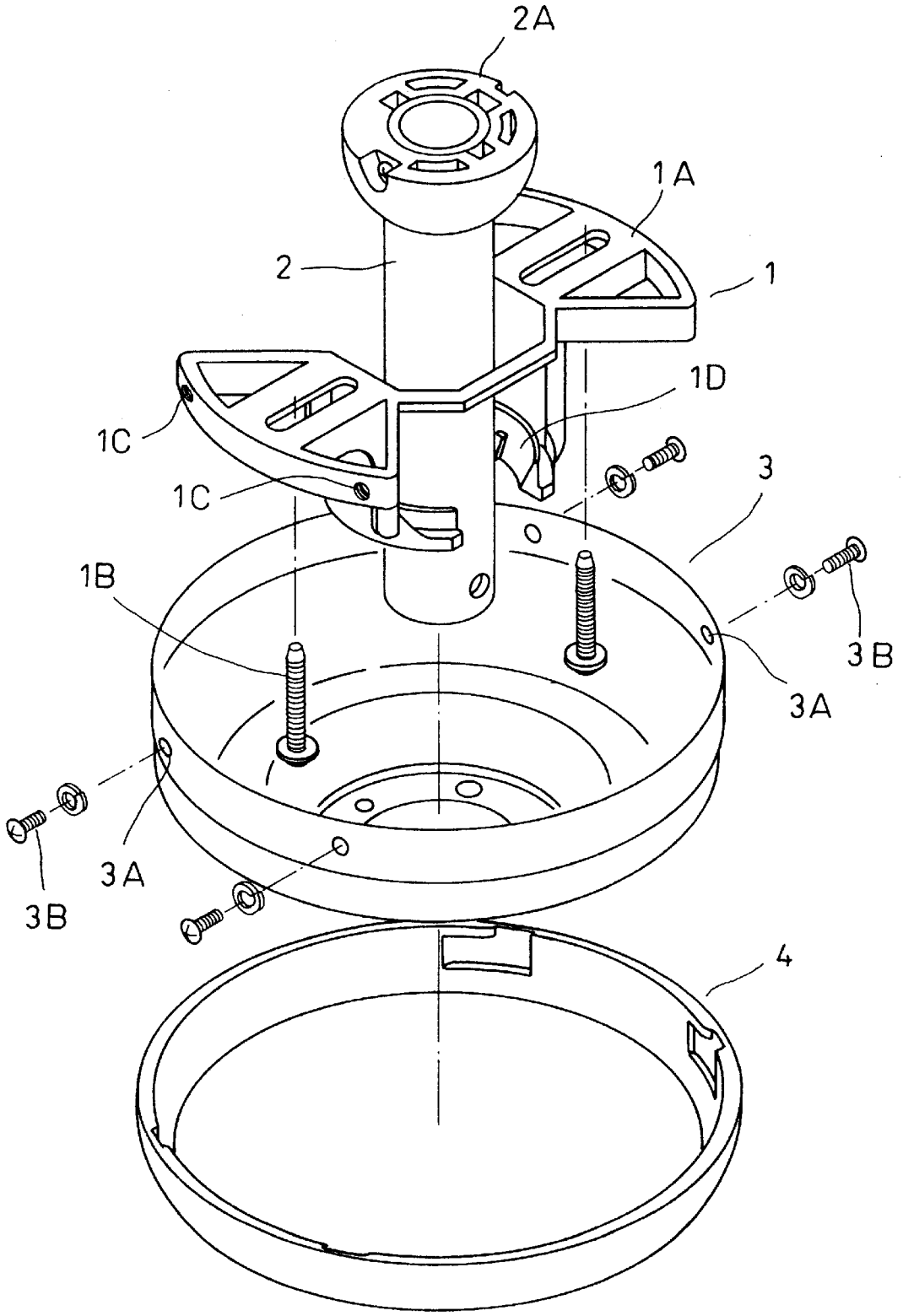
F I G. 1 PRIOR ART
FIG. 1 is an exploded drawing of a conventional ceiling fan mount.
Figure 2:
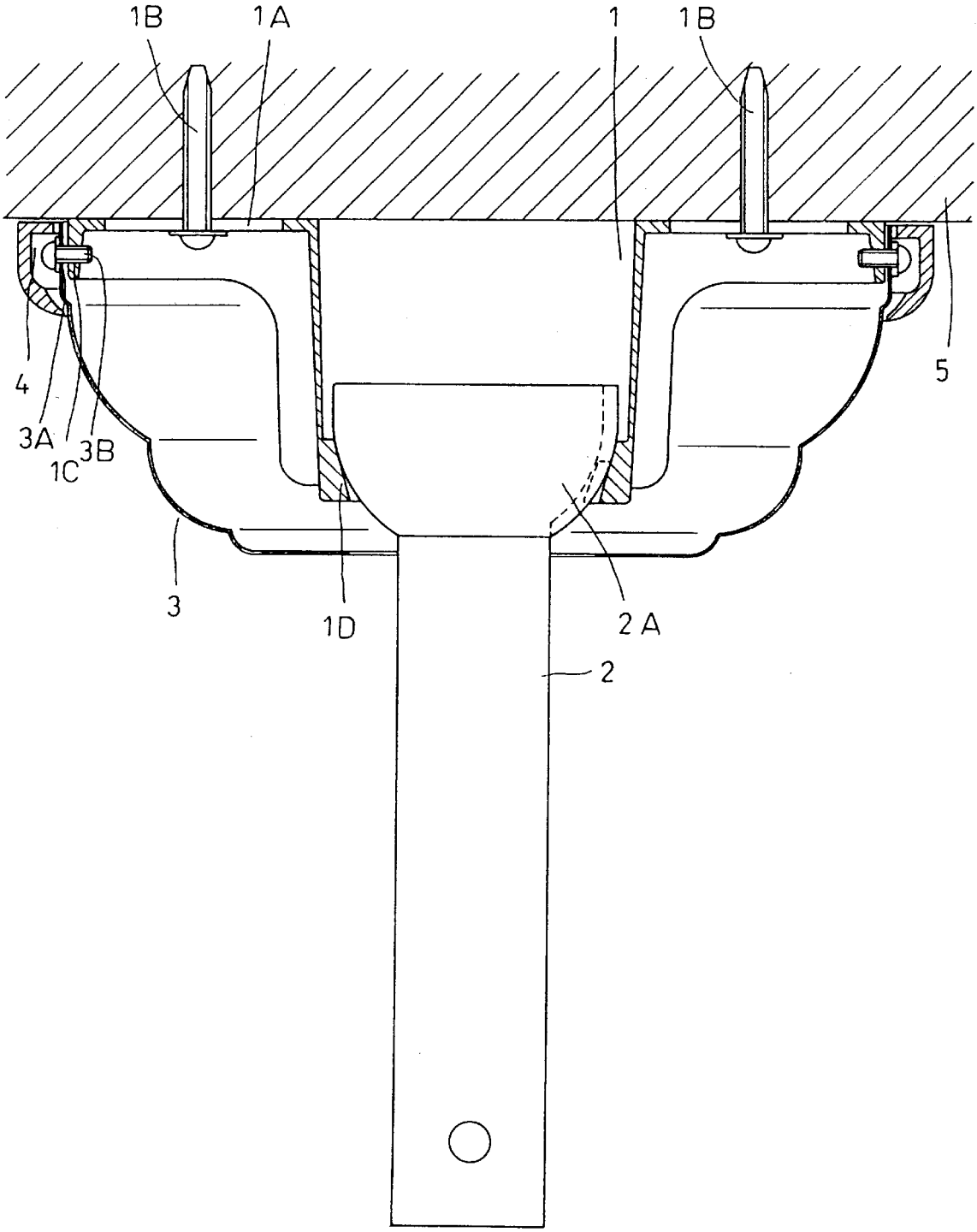
FIG. 2 PRIOR ART
FIG. 2 is a cross-sectional drawing of a conventional ceiling fan mount.
Figure 3:
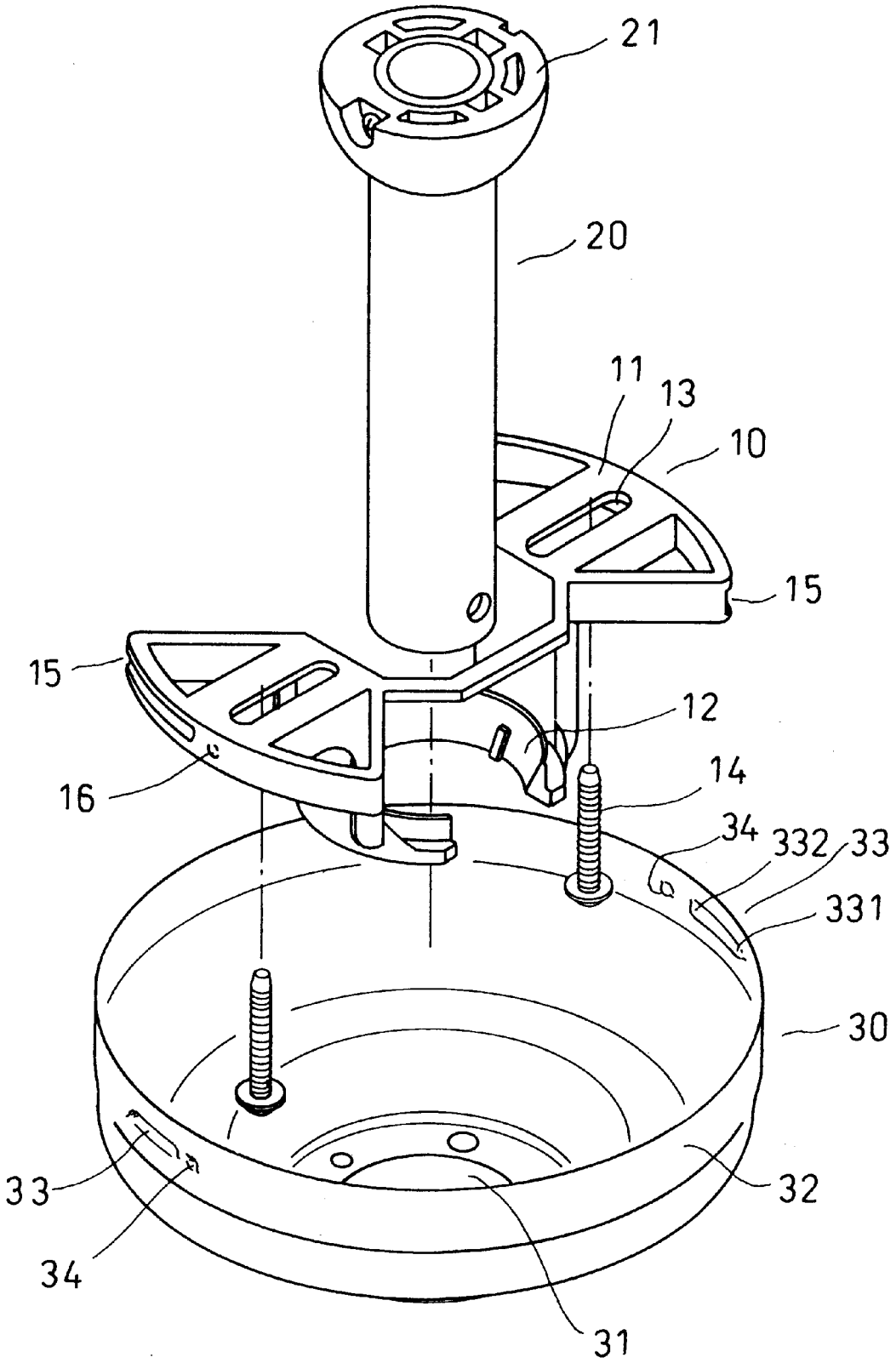
FIG. 3 is an exploded drawing of an embodiment of the invention herein.

Referring to FIG. 3, the improved structure ceiling fan mount of the invention herein is comprised of a suspender frame 10, a suspender rod 20, and a mount cover 30.

Of which, the said suspender frame 10 has a flat butterfly-shaped slidable mounting plate 11 that is installed onto the ceiling and extending downward from the center mounting plate 11 is a carrier fixture 12 with a C-shaped receptacle, and there are elongated holes 13 formed through the mounting plate 11 for the insertion of screws 14 that fasten it to the ceiling; furthermore, there are diametrically aligned and horizontally oriented insertion slots 15 disposed in the thick lateral end areas of the mounting plate 11, with a mounting dimple 16 formed at the end of each said insertion slot 15.

The said suspender rod 20 is a straight tubular member providing for the suspension and mounting of a ceiling fan that has a hemispherical head section 21 of larger dimension at the top end which is retained in the carrier fixture 12 of the suspender frame 10, and will be not be further elaborated due to similarities to the conventional product.

Figure 4:
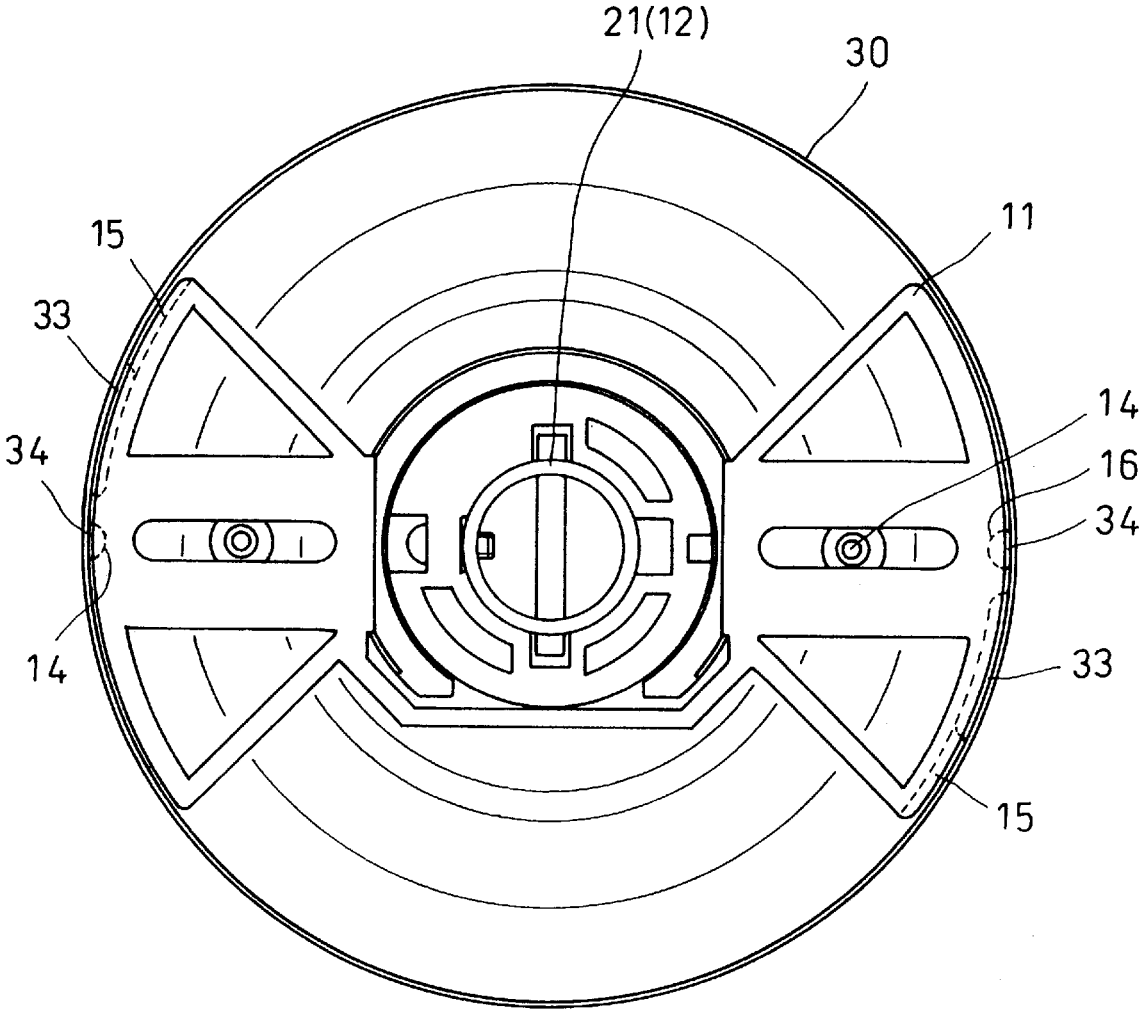
FIG. 4 is a cross-sectional drawing of the embodiment herein.

The mount cover 30 fits over the entire said suspender frame 10 to preserve exterior attractiveness and prevent corrosion and there is a center hole 31 providing for the insertion of the suspender rod 20 as well as a side wall 31 along the greater outer circumference, with protruding limit ribs 33 pressure formed horizontally along the said side wall 31 that are disposed in alignment with the insertion slots 15 of the suspender frame 10, with the leading edge 331 of each said limit rib 33 gradually increasing in angle towards the trailing edge 332 to enable by rotation the insertion and fixing of the said limit ribs 33 into the insertion slots 15 along the thicker lateral extent of the suspender frame 10 mounting plate 11, as indicated in FIG. 4; to ensure the sound conjoinment of the mount cover 30 to the suspender frame 10, a positioning nib 34 aligned with each of the mounting dimples 16 of the said mounting plate 11 is pressure formed inwards at the trailing end 332 of the said limit rib 33, such that when the limit ribs 33 protruding along the inner diameter of the mount cover 30 are rotated into the insertion slots 15 along the thicker lateral extent of the mounting plate 11, the positioning nibs 34 also enter the mounting dimples 16.

Figure 5:
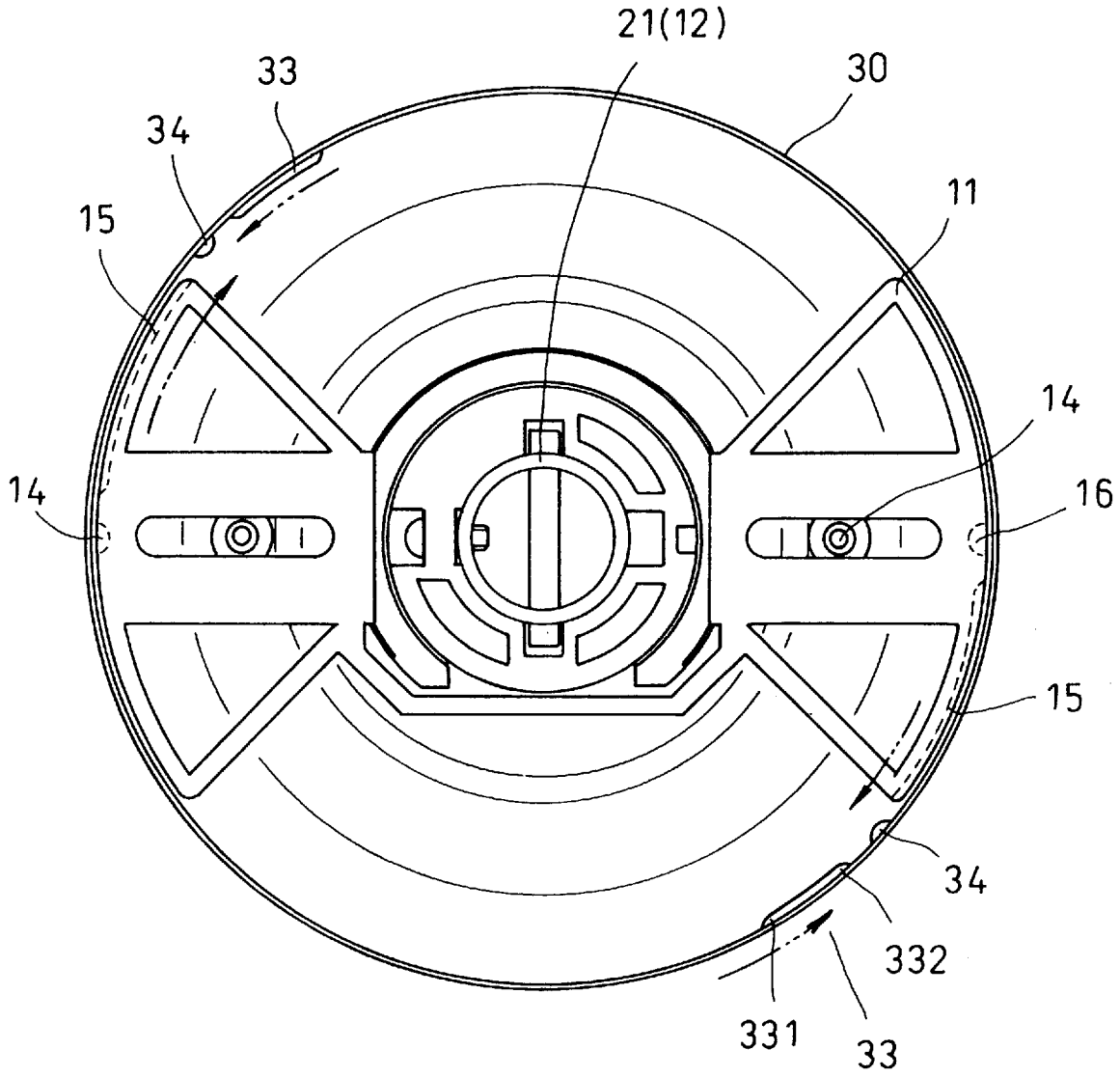
FIG. 5 is an orthographic drawing of the embodiment herein.

The said assemblage of the improved structure ceiling fan mount, as indicated in FIG. 3 and FIG. 4, is installed as with the conventional product by utilizing long screws 14 to fasten the flat mounting plate 11 of the butterfly-shaped suspender frame 10 to a ceiling, achieving the anchoring necessary to suspend and support the weight of the ceiling fan components, after which the suspender rod 20 is installed and positioned in the carrier fixture 12 of the suspender frame 10; although the installation operation has remained similar to that of the conventional product so far, the most significant difference of the invention herein is the mount cover 30 which, as indicated in FIG. 5, requires no screws for installation, but only requires pushing the mount cover 30 onto the circumference of the said suspender frame 10 mounting plate 11 and rotating it a certain number of degrees until the limit ribs 33 protruding evenly along the inner wall 32 of the mount cover 30 become engaged into the insertion slots 15 in the thicker extent of the said mounting plate 11, with the gradual increase in angle occurring from the leading edge 331 to the trailing edge 332 of the limit ribs 33 producing firm mechanical pressure against the insertion slots 15 and finally the engagement of the aligned positioning nibs 34 into the mounting dimples 16; with the exception of deliberate counter-clockwise manual rotation to disengage the said positioning nibs 34 from the mounting dimples 16, the mount cover 30 remains tightly conjoined to the circumference of the suspender frame 10; although simple, the structure of the invention herein is capable of eliminating the troublesome screw fastening operation of the conventional product, thereby accelerating the installation procedure, while also offering an attractive exterior appearance due to the absence of screw fasteners that often tend to rust; furthermore, unlike the conventional product, ceiling fan manufacturers are not required to bore and thread tap numerous holes along the circumference of the suspender fame 10 mounting plate 11 and the mount cover 30, thereby greatly reducing manpower cost and, furthermore, since screws are not required to install the mount cover 30, the inclusion of an additional protective fastening sleeve component is not required and only the said components of the invention herein are needed, which enables the invention herein to substantially lower production cost and, furthermore, provide considerably more practical value than the conventional product.

What is claimed is:

1. An improved structure ceiling fan mount comprised of a suspender frame having a flat mounting plate that is installed onto the ceiling, a carrier fixture with a receptacle extending downwards from the center, a suspender rod providing for the suspension and mounting of a ceiling fan and having a hemispherical head section at the top end that is retained in the said carrier fixture, and a mount cover that fits over the circumference of the said suspender frame, of which the innovations are:

The said mounting plate has diametrically aligned and horizontally oriented insertion slots formed in its thick lateral end areas, with a mounting dimple formed at the end of each said insertion slot; limit ribs are press formed in alignment with the said insertion slots of the said mounting plate along the inner diameter of the said mount cover and a positioning nib is press formed at the end of each said limit rib; based on the said arrangement, the said mount cover is rotated onto the circumference of the said mounting plate, which causes the said limiter ribs and the said positioning nibs to become respectively engaged into the said insertion slots and the said mounting dimples, which permits faster assembly because screws are not required.

2. As mentioned in claim 1 of the improved structure ceiling fan mount invention herein, each of the said limiter ribs of the said mount cover has a leading edge that gradually increases in angle towards the trailing edge.

* * * * *